US006080010A

United States Patent [19]

Daoud

[11] Patent Number: 6,080,010

[45] Date of Patent: Jun. 27, 2000

[54] BRACKET DESIGN FOR A BACK TO BACK INDIVIDUAL STRAIN RELIEF OF TWO MODULAR CONNECTORS

[75] Inventor: Bassel Hage Daoud, Parsippany, N.J.

[73] Assignee: Lucent Technologies Inc., Murray Hill, N.J.

[21] Appl. No.: 09/039,747

[22] Filed: Mar. 16, 1998

[51] Int. Cl.[7] ..... H01R 13/60

[52] U.S. Cl. ..... 439/540.1; 174/135

[58] Field of Search ..... 174/135, 72 A, 174/138 F, 138 G; 439/133, 345, 368, 369, 371; 24/521, 522

[56] References Cited

U.S. PATENT DOCUMENTS

| | | | |
|---|---|---|---|
| D. 287,963 | 1/1987 | Fasano et al. . | |
| 4,043,627 | 8/1977 | Ayer | 439/371 |
| 4,321,650 | 3/1982 | De Luca et al. . | |
| 4,343,525 | 8/1982 | Knickbocker | 439/371 |
| 4,463,999 | 8/1984 | Knickerbocker | 439/371 |
| 4,575,169 | 3/1986 | Duplatre et al. . | |
| 4,645,284 | 2/1987 | Duplatre et al. . | |
| 4,651,340 | 3/1987 | Marson . | |
| 4,658,422 | 4/1987 | Sparks . | |
| 4,740,168 | 4/1988 | Carney et al. . | |
| 4,752,232 | 6/1988 | De Luca . | |
| 5,044,981 | 9/1991 | Suffi et al. . | |
| 5,312,266 | 5/1994 | Daoud . | |
| 5,360,352 | 11/1994 | Rudy, Jr. et al. | 439/469 |
| 5,370,547 | 12/1994 | Daoud . | |
| 5,410,443 | 4/1995 | Pelegris . | |
| 5,613,884 | 3/1997 | Krivec | 439/822 |
| 5,685,732 | 11/1997 | Lane | 439/369 |

*Primary Examiner*—Lincoln Donovan

[57] ABSTRACT

A bracket for housing a mating cable connector pair includes a base portion, a higher sidewall and a lower sidewall that extend from the base portion, and a fastening strap that is fixedly connected to the lower sidewall. The base portion has a cut-out portion that securedly houses one member of a cable connector pair. The fastening strap extends from the lower sidewall, over the second member of the cable connector pair and engages to the higher sidewall. The bracket may also be constructed to house two mating cable connector pairs.

20 Claims, 4 Drawing Sheets

BRACKET DESIGN FOR A BACK TO BACK INDIVIDUAL STRAIN RELIEF OF TWO MODULAR CONNECTORS

FIELD OF THE INVENTION

The present invention relates to securing modular connectors, and, more specifically, to a bracket for securing one or more modular connectors in a terminal enclosure, so as to relieve strain on the connectors.

BACKGROUND OF THE INVENTION

Terminal enclosures are used to provide telephone lines from the street cables to multiple tenants in residential or commercial buildings. Typically telephone lines extend into a splicing connector disposed within the housing of the terminal enclosure. From the terminal enclosure, the telephone wires are extended to various tenant locations within the building via a cross-connect block. These terminal enclosures may be installed either inside or outside of the building.

In many instances it may become necessary to extend several telephone lines from the terminal enclosure to a single tenant unit in the building. For illustration purposes, one way to accomplish such a connection is to employ an interconnection system known as the RJ 21 connector. Typically, several telephone line pairs are bundled within a cable, which terminates at one end with a male or female RJ 21 interconnect plug. The other end of the cable is open so that the individual wires could be connected to connection pins disposed within the cross-connect block of the entrance terminal protector. Another cable that includes an appropriate RJ 21 interconnect plug engages with a building entrance protector terminal RJ 21 interconnect plug and extends to the desired unit within the building. However, the strength of the connection between the interconnect plugs is dependent on the manner of connection between the two connectors. For example, the two connectors may not be effectively connected where the two plugs tilt away from each other because of the strain exerted by their respective cables. As one skilled in the art will recognize, the problem of weak or unstable cable connections are not limited to RJ21 plugs, but are quite common with connections involving all sorts of interconnect plugs.

A number of different cable connectors are available for establishing electrical connections between the conductors of a pair of multi-conductor communication cables. These connectors suffer from the problem of getting disengaged while in service, causing a power out. The prior art discloses numerous methods to alleviate this problem. For example, some cable connectors are manufactured and designed so that they snap together, while other connectors involve the use of bail hooks, springs or similar devices. There are other connectors that have threaded fittings whereby the male and female connectors may be joined together by means of bolts.

While the prior art demonstrates various methods of securing mating cable connectors together, these prior methods suffer from one or more deficiencies. For example, the joining and connecting of cable connectors, particularly those that are bolted together, is time consuming. Furthermore, these securing methods have the disadvantage of being completely dependent on the design of the cable connectors.

To overcome the problem of poorly designed cable connectors, some have suggested the use of brackets with the cable connectors. These brackets are usable with a variety of cable connectors, and are not dependent on the connection mechanisms of the cable connectors. The use of Velcro® straps for fixedly fastening the two mating connectors together has been suggested. However, engaging and removal of the Velcro® fasteners tend to be difficult and cumbersome.

In some situations, two mating connector pairs are disposed back-to-back adjacent to each other. Velcro® straps have also been employed in such instances to secure the connections of the mating connector pairs. However, the lateral force produced by the Velcro® fasteners may result in tilting and damage to the connectors. Additionally, in the prior art, removing one connector requires disconnection of security from all of the other connectors as well.

Thus there is a need for a bracket for cable connectors that provides for adequate support for cable connections, easy engagement and disengagement of the connections, and that incorporates fastening means that keeps the connectors fixedly fastened, without exerting lateral force on the connectors.

SUMMARY OF THE INVENTION

In accordance with one embodiment of the invention, a bracket is designed with a high wall on one side, while having a short wall on the other side. The short wall incorporates a strap, such that one side of the strap is fixedly secured to a slit disposed on the short wall. The high wall is designed with a slit on its top portion for receiving the other end of the strap.

To facilitate the detachment of the strap, a handle-like device is provided on the top portion of the strap. While the short wall extends upwards in a straightly fashion, the high wall tilts away from the center of the bracket.

In accordance with another embodiment of the invention, a bracket is designed in a "W" shape to fixedly secure two cable connections, side by side. In this embodiment, the short wall is in the center and the two high walls are on the outside, such that the short wall terminates two straps back to back that extend to the two high walls.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

FIG. 3(*b*) illustrates another view of the top portion of the bracket illustrated in FIG. 1, along with a cable connector in use.

DETAILED DESCRIPTION OF THE DRAWINGS

Figure 1:
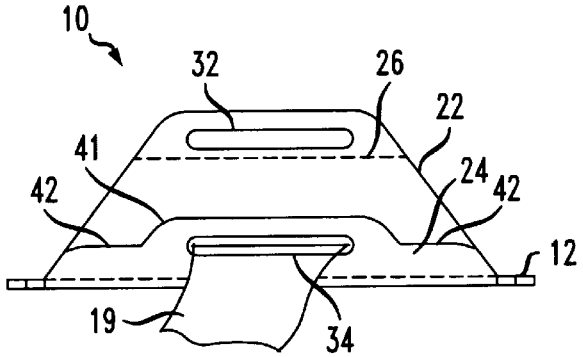
FIG. 1 illustrates a side view of the bracket that houses a single cable connector pair in accordance with one embodiment of the invention.

FIG. 1 illustrates a cable connector bracket 10 in accordance with one embodiment of the invention, although the invention is not limited in scope in that respect. For example, other types of brackets may include the inventive features disclosed herein. Bracket 10 includes a base portion 12 and two sidewalls 22 and 24. Advantageously, sidewall 22 is higher than sidewall 24. While it is preferred that the height of sidewall 22 correspond with the vertical height of a cable connector, the scope of the present invention is not limited by the exact height, and variations in the height of sidewall 22 are possible. For RJ21 application, the height of the higher sidewall 22 is around one inch. The top portion of sidewall 22 is provided with slot 32. Preferably, the top portion of sidewall 22 is bent to the side and away from the center of bracket 10. The bent is shown as dotted line 26 in FIG. 1.

By providing a higher sidewall 22, bracket 10 is able to provide support to the cable connection on one side of the bracket 10, such that the top connector is unable to move towards the side of the higher wall 22. This restriction in the movement of the cable connectors has the advantage over the prior art brackets of ensuring a stronger connection between two cable connectors housed in bracket 10.

In the preferred form, the lower sidewall 24 is approximately 0.5 inches in height along its middle portion 41 and approximately 0.25 inches high along its side portions 42. A slit 34 is provided at a height of approximately 0.25 inches from base portion 12 in center portion 41 of lower sidewall 24. A strap 19 is made of hoop and loop type fasteners, such as Velcro®, and fixedly attached in slit 34 of lower sidewall 24. Although it is preferable to use a hoop and loop fastener for strap 19, a variety of different fastening mechanisms, such as press buttons may be employed. With the use of strap 19 to fixedly secure cable connector 7, a stronger connection is ensured by restricting cable connector's 7 movement away from base portion 12. Strap 19 may be provided with a small handle (FIG. 6) for easy fastening and removal from slit 32. At slit 34 of lower sidewall 24, strap 19 may be fixedly attached using a variety of mechanisms, such as stitching, heat-sealing, etc.

Figure 2:
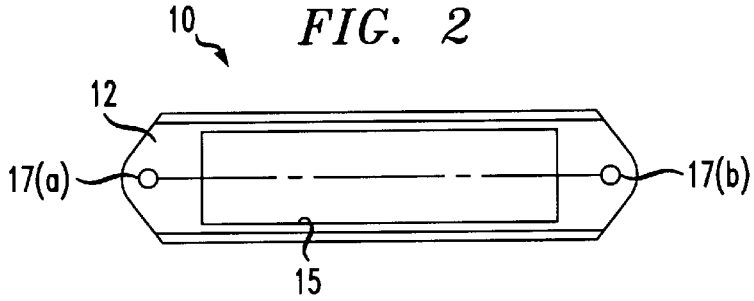
FIG. 2 illustrates a top view of a bracket illustrated in FIG. 1.

Base portion 12 is provided with two mounting holes 17(*a*), 17(*b*), and a central cut-out 15 as shown in FIG. 2. Mounting holes 17(*a*), (*b*) are used for inserting screws (FIG. 3(*a*)) that fixedly mount the bracket within a housing. Cut-out 15 supports and houses the lower cable connector that is mated with cable connector 7. While central cut-out 15 is preferably rectangular in shape, it is to be noted that the present invention is not limited by the shape of central cut-out 15, and cut-out 15 may be shaped circular, triangular, elliptical, etc.

Figure 3A:
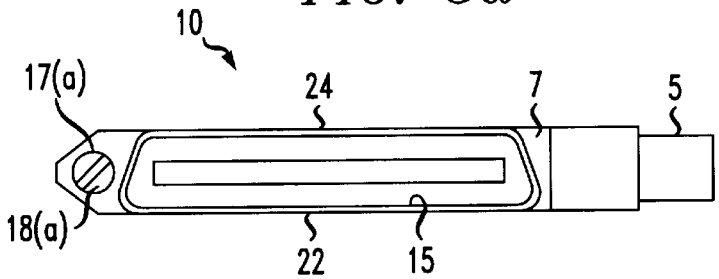
FIG. 3(*a*) illustrates a top view of the bracket illustrated in FIG. 1, along with a cable and cable connector in use.
Figure 3B:
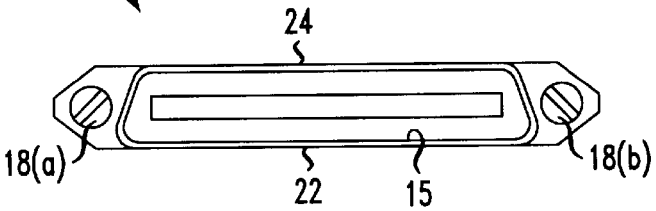

During use, the mating portions of the two cable connectors are secured together and bracket 10 houses the connection. Next, bracket 10 is mounted within a terminal housing with the aid of screws 18(*a*) and 18(*b*), as shown in FIGS. 3(*a*)–3(*b*). Once the two cable connectors have been connected by inserting the male portion of one connector into the female portion of the other cable connecter, cable connector 7 is firmly secured in the central cut-out 15. In this position, the cable connector is prevented from being bent away from bracket 10, that houses the connector pair because of support from higher sidewall 22.

To further secure the connection between the two mating cable connectors, strap 19 is extended over the top of cable connector 7 (FIG. 3(*a*)) and inserted into slit 32 of higher sidewall 22, before being fixedly fastened. The higher height and/or the presence of a bent in the top portion of higher sidewall 22 allows for an easy and convenient insertion and removal of strip 19 from slit 32.

Figure 4:
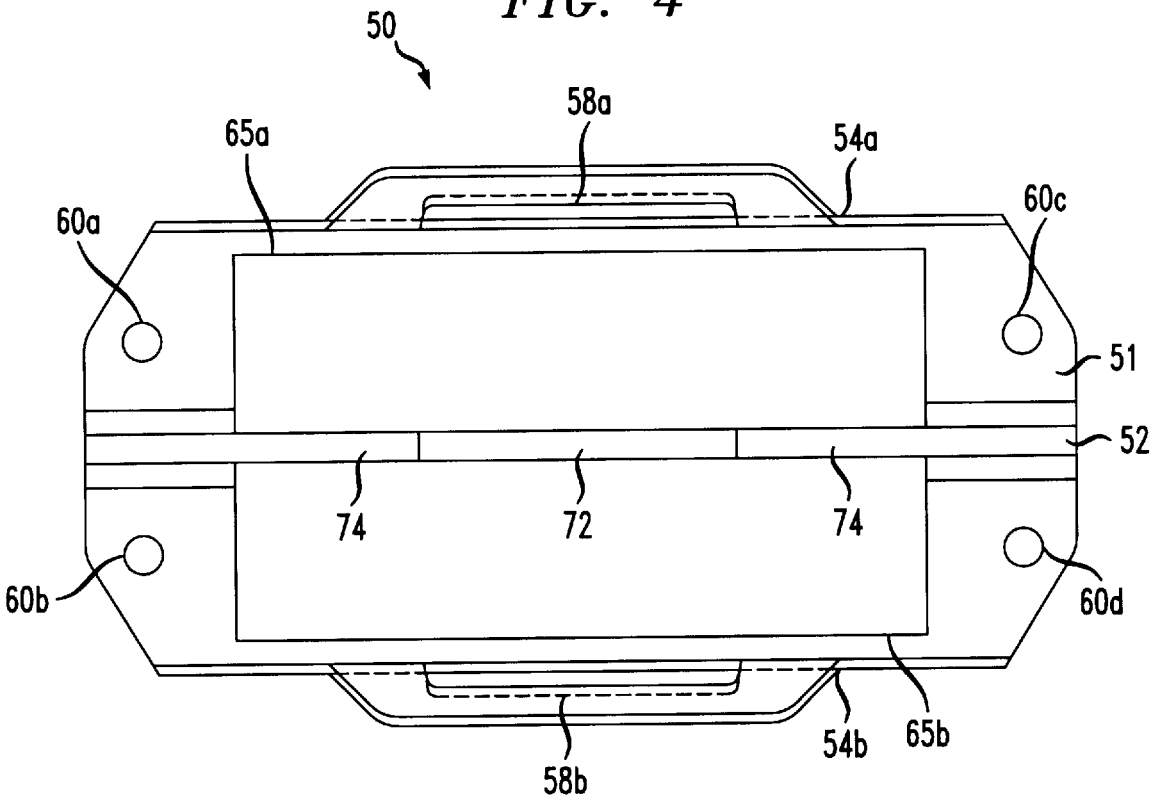
FIG. 4 illustrates a top view of another embodiment of the bracket, in which two cable connectors may be housed in accordance with another embodiment of the invention.
Figure 5:
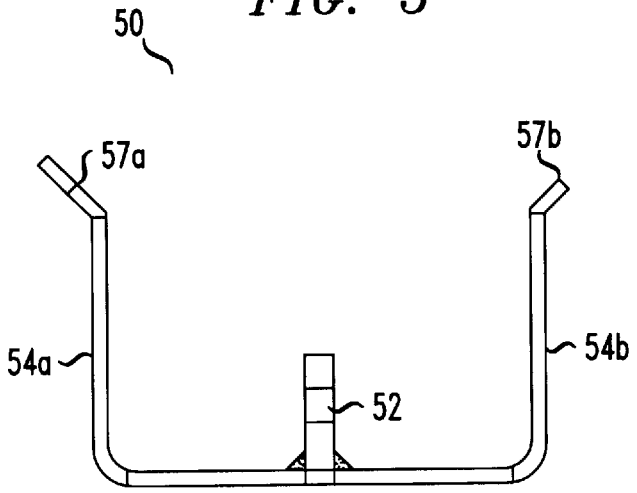
FIG. 5 illustrates a front view of the bracket shown in FIG. 4.
Figure 6:
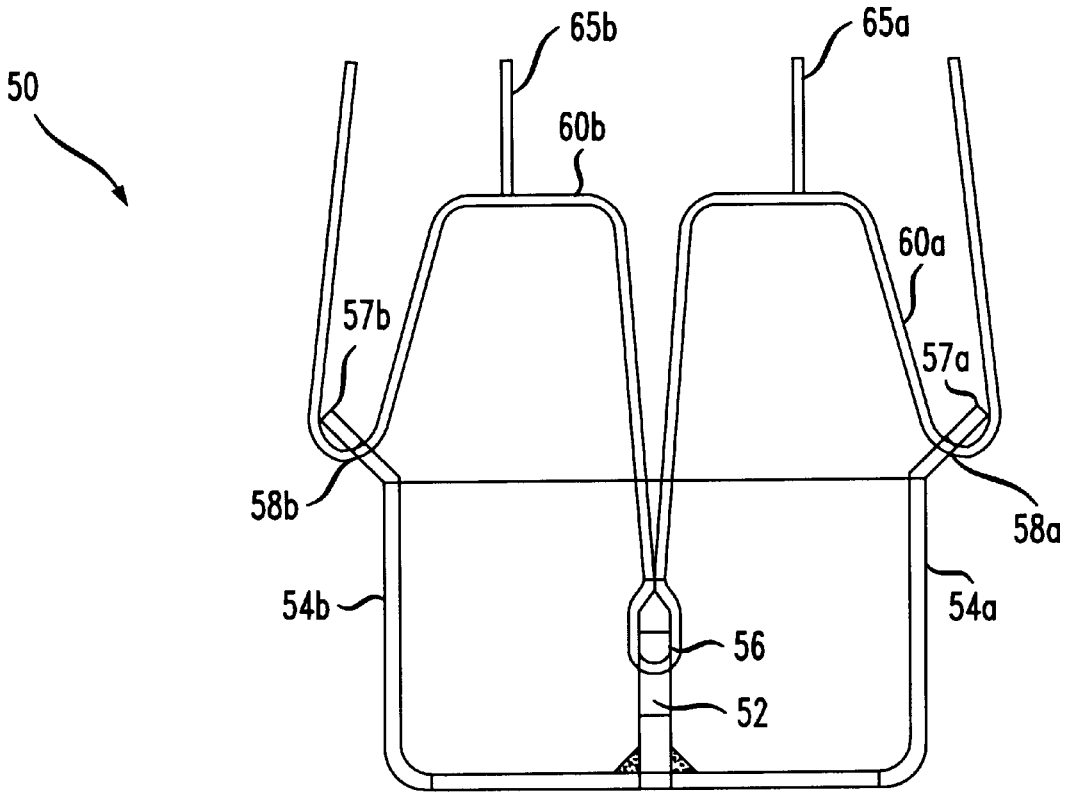
FIG. 6 illustrates another view of the front portion of the bracket shown in FIG. 4, along with straps for fastening the inserted cable connector, in accordance with another embodiment of the present invention.
Figure 7:
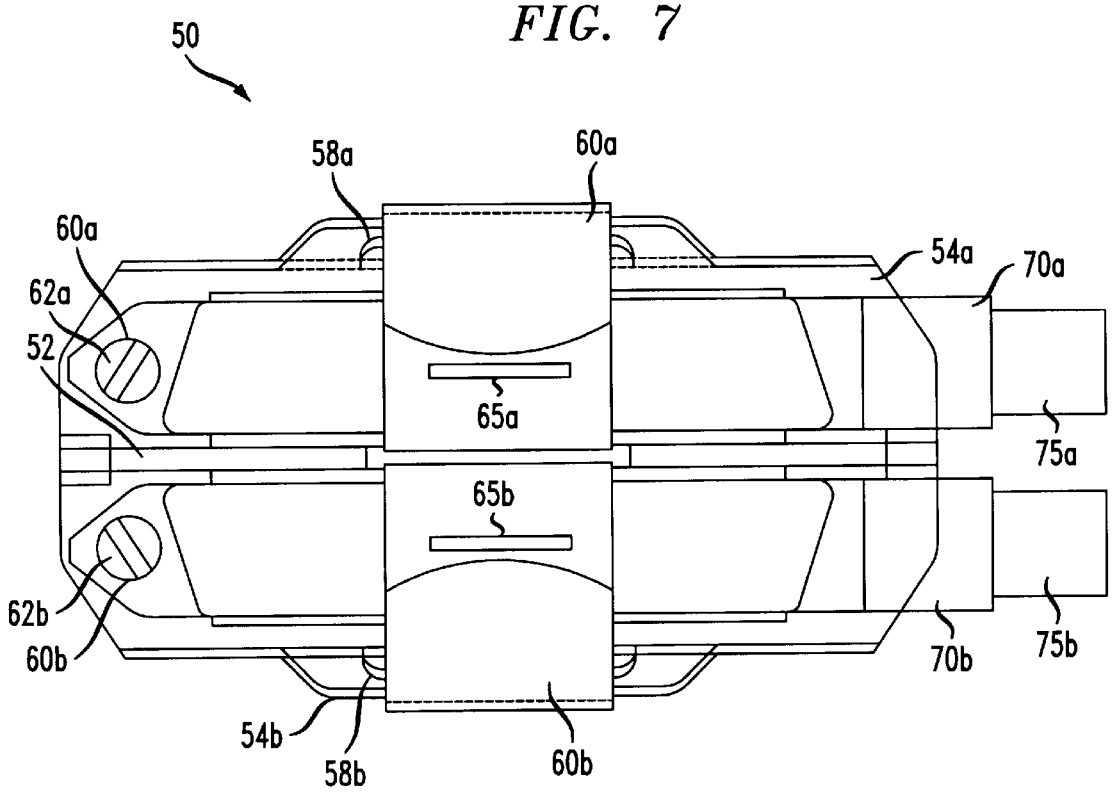
FIG. 7 illustrates the top portion of the bracket shown in FIG. 6, along with the inserted cable connector, in accordance with another embodiment of the invention.

Another embodiment of the present invention is shown in FIGS. 4–8. According to this embodiment of the invention, FIG. 4 shows a W-shaped bracket 50 that is capable of housing two connections in cut-outs 65(*a*), (*b*) that involve two mating cable connector pairs (FIG. 7). At base 51 of W-shaped bracket 50 four circular mounting holes 60(*a*)–(*d*), and two rectangularly shaped central cut-outs 65(*a*) and 65(*b*) are provided. Cut-outs 65(*a*), (*b*) support and house the lower cable connectors that are mated with cable connectors 70(*a*) and 70(*b*) respectively. While central cut-outs 65(*a*), (*b*) are preferably rectangular in shape, it is to be noted that the scope of the present invention are not limited by the shapes of central cut-outs 65(*a*), (*b*).

Figure 8:
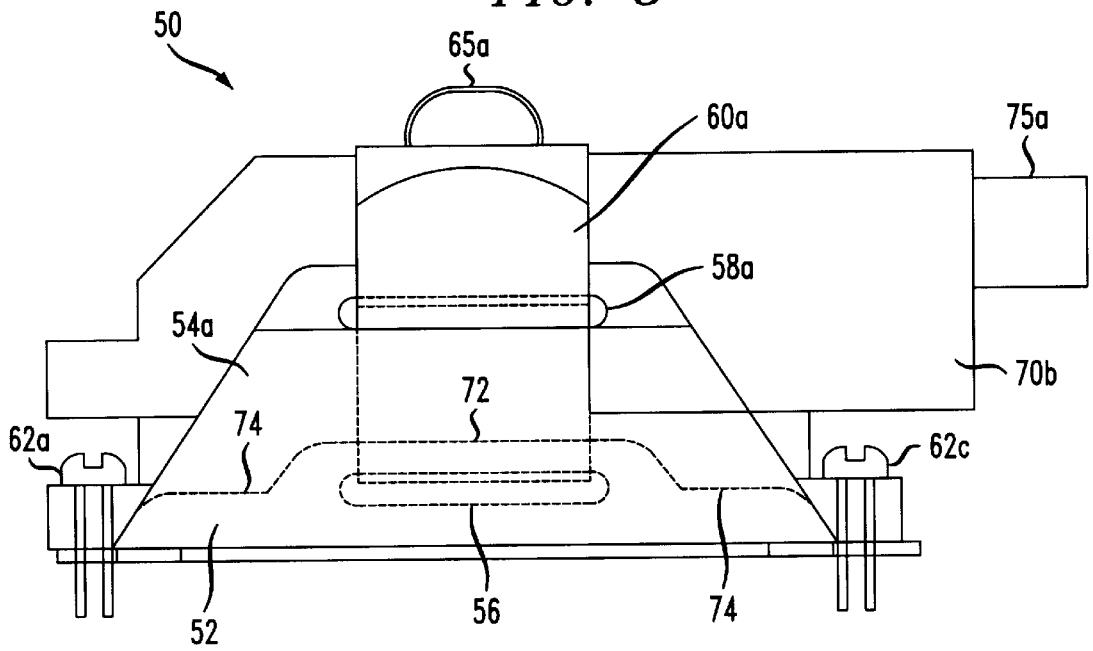
FIG. 8 illustrates a side view of the bracket shown in FIG. 7.

The mating portions of the cable connectors are secured together and bracket 50 houses the connection. W-shaped bracket 50 is mounted by screws 62(*a*)–(*d*) (FIG. 7) within a terminal housing with the aid of screws, as shown in FIG. 7–8.

W-shaped bracket 50 is designed with a lower wall 52 in the center and two higher sidewalls 54(*a*) and 54(*b*) on the outer sides, as further shown in FIG. 5. For RJ21 type connectors, the height of higher sidewalls 54(*a*), (*b*) is approximately one inch. The top portion of higher sidewalls 54(*a*), (*b*) is provided with slits 58(*a*), (*b*). Preferably, the top portion of higher sidewalls 54(*a*), (*b*) is bent to the side and away from the center. The bent portion is shown as 57(*a*), (*b*) in FIG. 5. While it is preferable to provide a bent in the top portion of higher sidewalls 54(*a*), (*b*), it is to be noted that the scope of the present invention is not dependent on the presence or absence of bent portion 57(*a*), (*b*) in higher sidewalls 54(*a*), (*b*).

Lower wall 52 is approximately 0.5 inches in height along its middle portion 72 and approximately 0.25 inches high along its side portions 74. A slit 56 is provided at a height of approximately 0.25 inches from base portion 51 in center portion 72 of lower wall 52. As FIG. 6 illustrates, two straps 60(*a*), (*b*) are fixedly provided in slit 56 of lower wall 52 in the center portion of W-shaped bracket 50.

Two straps 60(*a*), (*b*) made of hoop and loop type fasteners, such as Velco, are fixedly attached back to back in slit 56 of lower wall 52. Although it is preferable to use a hoop and loop fastener for straps 60(*a*), (*b*), a variety of different fastening mechanisms, such as press buttons may be employed. With the use of straps 60(*a*), (*b*) to fixedly secure cable connector 70(*a*), (*b*), a stronger connection is ensured by restricting the movement of cable connectors 70(*a*), (*b*) away from the center W-shaped bracket 50. Straps 60(*a*), (*b*) may be provided with small handles 65(*a*), (*b*) (FIG. 6) for easy fastening and removal from slits 58(*a*) and 58(*b*). At slit 56 lower wall 52, straps 60(*a*), (*b*) may be fixedly attached using a variety of mechanisms, such as stitching, heat-sealing, etc. In use, straps 60(*a*), (*b*) extend over the top of the cable connectors 70(*a*), (*b*) (FIG. 7), and are inserted into slits 58(*a*), (*b*) of higher sidewalls 54(*a*), (*b*), before being fixedly fastened.

It is preferred that W-shaped bracket 50 be made from metal. However, it is possible to utilize the present invention by constructing the bracket 50 from other materials as well, including ceramic.

Thus, in accordance with the present invention a bracket for securing one or more mating cable connector pairs is disclosed that provides adequate support for cable connections, easy engagement and disengagement of the connections, and that incorporates fastening means for keeping the connectors fixedly fastened, without exerting lateral force on the connectors.

The foregoing merely illustrates the principles of the inventions. It will thus be appreciated that those skilled in the art will be able to devise various arrangements which, although not explicitly described or shown herein, embody the principles of the invention and are thus within its spirit and scope.

What is claimed is:

1. A bracket for housing a mating cable connector pair, comprising:

a base portion, said base portion having a cut-out portion for securedly housing one of said cable connector pair;

a first sidewall and a second sidewall, said first sidewall and said second sidewall extending from said base portion, wherein the distance said first sidewall extends from said base portion is greater than the distance said second sidewall extends from said base portion; and a fastening strap fixedly connected to said second sidewall, said fastening strap extending over the top portion of other one of said cable connector pair and engaging with said first sidewall, such that said first sidewall is substantially aligned with said cable connector pair.

2. The bracket in accordance with claim 1, wherein said base portion comprises two mounting holes for fixedly securing the bracket within a housing.

3. The bracket in accordance with claim 1, wherein said second sidewall comprises a slit for connecting said fastening strap to said second sidewall.

4. The bracket in accordance with claim 1, wherein a upper portion of said first sidewall is bent away from the center of said bracket.

5. The bracket in accordance with claim 1 or claim 4, wherein said first sidewall comprises a slit for engaging said fastening strap.

6. The bracket in accordance with claim 1, wherein said strap comprises a handle for facilitating removal of said strap from slit on said first sidewall.

7. The bracket in accordance with claim 1, wherein said strap is a hoop and loop fastener.

8. The bracket in accordance with claim 1, wherein the bracket is made from metal.

9. The bracket in accordance with claim 1, wherein said cut-out portion is rectangular.

10. The bracket in accordance with claim 1, wherein said fastening strap is fixedly attached to said second sidewall by heat-sealing.

11. A W-shaped bracket for housing two mating cable connector pairs, comprising:

a base portion, said base portion having two cut-out portions for securedly housing one member of each cable connector pairs;

two sidewalls and a centerwall disposed between said sidewalls in the center of the bracket, said sidewalls and said centerwall extending from said base portion, wherein the distance said sidewalls extend from said base portion is greater than the distance said centerwall extends from said base portion; and two fastening straps fixedly connected to said centerwall, each of said straps extending over the top portions of second members of each cable connector pairs and engaging with one of said sidewalls.

12. The bracket in accordance with claim 11, wherein said base portion comprises four mounting holes for fixedly securing the bracket within a housing.

13. The bracket in accordance with claim 11, wherein said centerwall comprises a slit for fixedly attaching said fastening straps to said centerwall.

14. The bracket in accordance with claim 11, wherein upper portions of said sidewalls are bent outwardly from the bracket.

15. The bracket in accordance with claim 11 or claim 14, wherein each of said sidewalls comprises a slit for engaging said fastening straps.

16. The bracket in accordance with claim 11, wherein each of said straps comprises a handle for facilitating fastening and removal of said straps from slits on said sidewall.

17. The bracket in accordance with claim 11, wherein said straps are hoop and loop fasteners.

18. The bracket in accordance with claim 11, wherein the bracket is made from metal.

19. The bracket in accordance with claim 11, wherein said cut-out portions are rectangular.

20. The bracket in accordance with claim 11, wherein said fastening straps are fixedly attached to said centerwall by heat-sealing.

* * * * *